United States Patent [19]

Kagerhuber et al.

[11] 4,224,852

[45] Sep. 30, 1980

[54] SHEARING MACHINE TO BE USED FOR A RUN-OUT ROLLER TABLE OF A CONTINUOUS CASTING PLANT

[75] Inventors: Franz Kagerhuber, Traun; Wolfgang Lederer, Haid, both of Austria

[73] Assignee: Voest-Alpine Aktiengesellschaft, Linz, Austria

[21] Appl. No.: 958,421

[22] Filed: Nov. 7, 1978

[30] Foreign Application Priority Data

Nov. 22, 1977 [AT] Austria ..... 8336/77

[51] Int. Cl.[3] ..... B23D 25/04

[52] U.S. Cl. ..... 83/319; 83/303; 83/320; 83/859; 164/263

[58] Field of Search ..... 164/263, 262; 83/319, 83/320, 303, 859

[56] References Cited

U.S. PATENT DOCUMENTS

| | | | |
|---|---|---|---|
| 2,351,868 | 6/1944 | Morgan | 83/303 |
| 3,496,813 | 2/1970 | Valente | 83/320 X |
| 3,497,195 | 2/1970 | Kalkhof | 164/263 X |
| 3,800,645 | 4/1974 | Alcock et al. | 83/320 |

FOREIGN PATENT DOCUMENTS

| | | |
|---|---|---|
| 290749 | 6/1971 | Austria . |
| 2226251 | 12/1973 | Fed. Rep. of Germany . |
| 2355937 | 6/1974 | Fed. Rep. of Germany . |
| 225037 | 11/1924 | United Kingdom . |
| 477582 | 12/1937 | United Kingdom . |
| 706953 | 4/1954 | United Kingdom . |
| 844880 | 8/1960 | United Kingdom . |
| 1141231 | 1/1969 | United Kingdom . |
| 1186582 | 4/1970 | United Kingdom . |
| 1294517 | 11/1972 | United Kingdom . |
| 1365561 | 9/1974 | United Kingdom . |
| 1377337 | 12/1974 | United Kingdom . |

*Primary Examiner*—J. M. Meister

*Attorney, Agent, or Firm*—Brumbaugh, Graves, Donohue & Raymond

[57] ABSTRACT

In a shearing machine for a run-out roller table of a continuous casting plant, in particular a multiple-strand continuous casting plant for billets, including an upper and a lower cutter arranged in a shearing frame and movable towards and away from each other by means of drive and control aggregates. The shearing frame is mounted on a machine frame so as to be displaceable in the longitudinal direction of the run-out roller table. The shearing frame rests loosely on the machine frame, which machine frame exceeds the run-out roller table in height. The drive and control aggregates are mounted on the shearing frame and form a construction unit with it.

3 Claims, 3 Drawing Figures

SHEARING MACHINE TO BE USED FOR A RUN-OUT ROLLER TABLE OF A CONTINUOUS CASTING PLANT

BACKGROUND OF THE INVENTION

The invention relates to a shearing machine for a run-out roller table of a continuous casting plant, in particular a multiple-strand continuous casting plant for billets, wherein the shearing machine has cutters arranged in a shearing frame so as to be movable towards each other by means of drive and control aggregates, and the shearing frame is mounted on a machine frame so as to be displaceable in the longitudinal direction of the run-out roller table.

With multiple-strand continuous casting plants, such as multiple-strand continuous casting plants for billets, there is a problem with guiding the strands one beside the other as close as possible. Efforts have been made to arrange the supporting and guiding means for the strands to save as much space as possible in order, on the one hand to be able to dimension the tundish arranged above the continuous casting moulds as small as possible (thus keeping the temperature loss of the steel as low as possible) and, on the other hand, to be able to design the supporting constructions and guiding means to utilize as little material and space as possible.

Due to the compact construction, the possibility of exchanging shearing machines provided in a run-out roller table of the supporting and guiding means, in case of a failure, is connected with difficulties. With the plants built so far, the exchange of one of the closely adjacent shearing machines requires a lot of time, so it has not been possible to use the relatively short span of time between two consecutive castings for this purpose. Also repair of the shearing machines while they are in place is connected with special difficulties on account of the compact construction, thus causing, as with the exchange of a shearing machine, considerable losses of time that also affect the metallurgical plants.

SUMMARY OF THE INVENTION

The invention aims at avoiding these disadvantages and difficulties and has as its object to provide a shearing machine of the initially-defined kind, whose installation into, and removal from, the continuous casting plant is simple and can be carried out within a short span of time, such as the time available between two immediately consecutive castings.

This object is achieved according to the invention in that the shearing frame rests loosely on the machine frame, which, in terms of height, exceeds the run-out roller table. The drive and control aggregates are mounted on the shearing frame and form a construction unit with the same. By this means, it is possible to lift the shearing machine vertically upward out of the continuous casting plant by means of a lifting device, such as a crane suspension, without it being necessary to pinch off the hydraulic conduits of the controls and to carry out manipulations at the shearing frame and the machine frame. Installation of an intact shearing machine is effected by a simple lowering of the shearing machine until the latter comes to rest with its shearing frame upon the machine frame.

According to a preferred embodiment in which the shearing machine is equipped with a displacement mechanism fastened to the machine frame and engaged with the shearing frame, the displacement mechanism is connectable with the shearing frame by a hook coupling that allows for vertical movements of the shearing frame.

Advantageously, the shearing machine includes a hold-down appliance adjustable to the strand surface by means of a pressure medium cylinder that is in flow-connection with another pressure medium cylinder actuating the lower cutter, by means of a pressure medium conduit and a pressure regulating valve. With this arrangement no additional consumption of pressure medium is necessary for the hold-down appliance, so the drive aggregates can be dimensioned in a more compact way.

BRIEF DESCRIPTION OF THE DRAWINGS

The invention will now be explained in more detail by way of one embodiment and with reference to the accompanying drawings, in schematical illustration, wherein.

DESCRIPTION OF AN ILLUSTRATIVE EMBODIMENT

Figure 1:
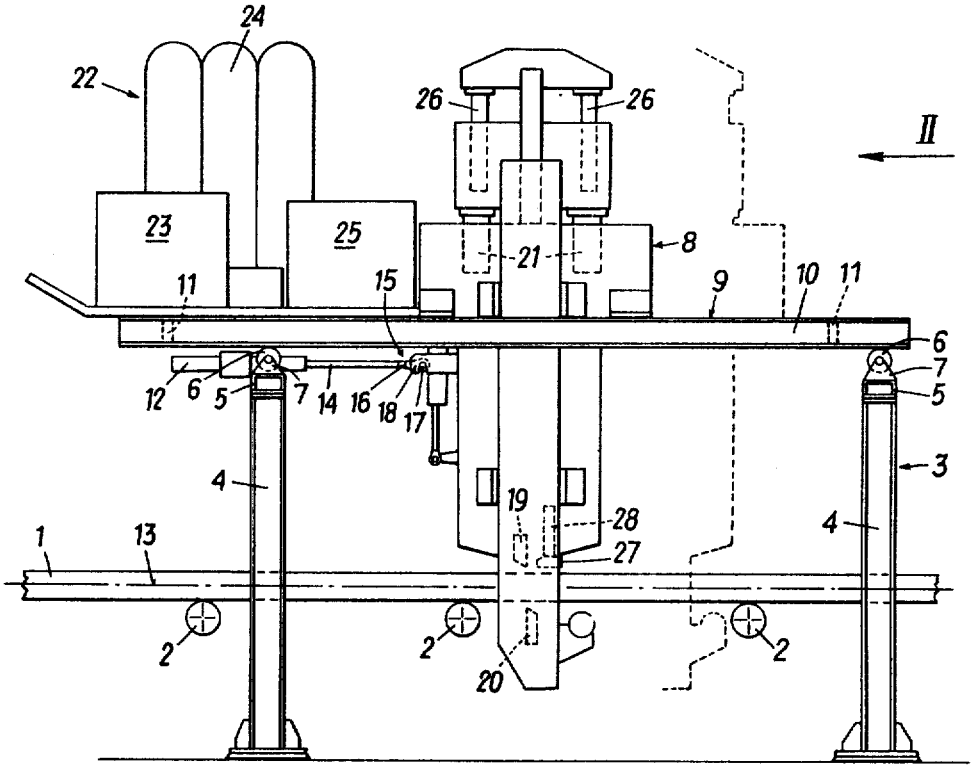
FIG. 1 is a side view of a shearing machine arranged in a run-out roller table of a multiple-strand continuous casting plant for billets.
Figure 2:
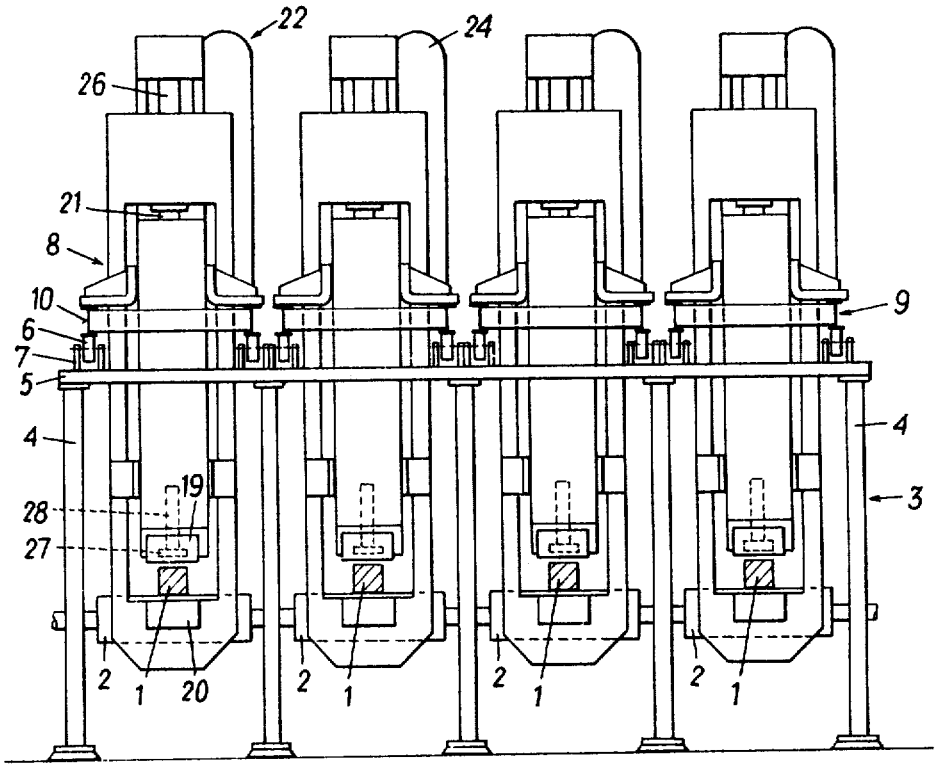
FIG. 2 illustrates a front view in the direction of the arrow II of FIG. 1, and FIG. 3 schematically illustrates the drive for the hold-down appliance.

Billets 1 are guided as closely adjacent each other as possible in a run-out roller table 2 of a four-strand continuous casting plant. The rollers of the run-out roller table are rotatably mounted in a supporting construction which, for reasons of clarity, is not illustrated. The run-out roller table 2 is bridged over by a machine frame 3 composed of vertical struts 4 and horizontal connecting carriers 5. On each of the connecting carriers, two running rollers 6 are rotatably mounted symmetrically above each billet 1 and by means of brackets 7.

The shearing machine, which in general is denoted by 8, is mounted on a shearing frame 9 which is formed of two longitudinal carriers 10 and transverse carriers 11 connecting the latter. The frame 9 rests with its longitudinal carriers 10 loosely on the running rollers 6 and, by means of a displacement mechanism which is designed as a pressure medium cylinder 12, it is displaceable to and fro along the longitudinal axes 13 of the billets 1, whereby it is possible to carry out the shearing procedure during conveyance of the billets. After termination of the shearing procedure, the shearing machine will be in the position shown in FIG. 1 by dashed lines. In order to prevent forces caused by the conveying means from acting upon the billets to be cut, the displacement speed of the shearing machine during the cutting procedure is chosen to be at least equal to the conveying speed of the billets.

Since the machine frame 3 exceeds the run-out roller table 2 in terms of height, the shearing frame can be lifted from the run-out roller table 2, together with the shearing machine, without being impeded by the rollers of the run-out roller path 2.

The pressure medium cylinder 12 is fastened to the machine frame 3 and is connected via its piston 14 to the shearing machine by means of a hook coupling 15. The hook coupling comprises two parts, one part 16 of which is arranged at the end of the piston 14 penetrated by a pin 17. The other part is designed as a downwardly open hook 18 embracing the pin. Thereby it is possible to install and remove the shearing frame together with the shearing machine in the vertical direction, without it being necessary to carry out manipulations at the coupling 15.

For actuating the lower cutter 20, which is movable towards and away from the upper cutter 19, two pressure medium cylinders 21, referred to as cutting cylinders, are provided. These cutters are supplied with pressure medium from a pressure medium supply unit 22 mounted on the shearing frame and comprising a pump tank unit 23, a storage basin 24 and a valve stand 25. Also pressure medium cylinders 26, which are responsible for the return movement of the lower cutter 20, as well as the pressure medium cylinder 28 that actuates the hold-down appliance 27, are supplied by this pressure medium supply unit 22.

Figure 3:
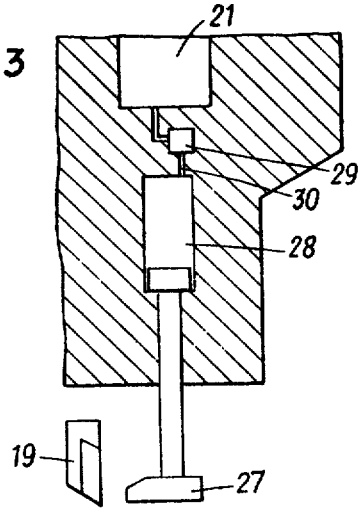

The hold-down pressure medium cylinder 28, as schematically illustrated in FIG. 3, is connected with the cutting cylinder 21 via a pressure regulating valve 29 and by a pressure medium conduit 30, so that the pressure medium urged out of the pressure medium cylinder 28 during cutting when lifting the hold-down appliance 27, will flow back into the cutting cylinder 21. This has the advantage that no additional consumption of pressure medium takes place for the hold-down appliance, so that the storage basin 24 need be dimensioned only for the pressure medium cylinders 21 and 26.

Driving of the pump tank unit 23 is effected by means of electricity, so that the only manipulation necessary for the removal of the shearing machine consists in interrupting the electric conduit.

What we claim is:

1. In a shearing machine to be used for a run-out roller table of a continuous casting plant, in particular a multiple-strand continuous casting plant for billets, of the type including a machine frame, a shearing frame mounted on said machine frame so as to be displaceable in the longitudinal direction of said run-out roller table, an upper and a lower cutter arranged in said shearing frame, and drive and control aggregates provided for moving said upper and said lower cutters towards and away from each other, the improvement which is characterized in that said machine frame exceeds said run-out roller table in terms of height, said shearing frame rests loosely on said machine frame, and said drive and control aggregates are mounted to said shearing frame and form a construction unit with said shearing frame which can be vertically removed from said machine frame without disconnection of the shearing or machine frames, or the drive and control aggregates.

2. A shearing machine as set forth in claim 1, wherein said drive and control aggregates include a cutter pressure medium cylinder actuating said lower cutter, and said shearing machine further comprises:

a hold-down appliance;

a holding pressure medium cylinder provided for said hold-down appliance, said hold-down appliance being adjustable to the surface of the strand by said holding pressure medium cylinder;

a pressure medium conduit; and a pressure regulating valve, said holding pressure medium cylinder being flow-connected to said cutter pressure medium cylinder by said pressure medium conduit and said pressure regulating valve.

3. In a shearing machine to be used for a run-out roller table of a continuous casting plant, in particular a multiple-strand continuous casting plant for billets, of the type including a machine frame, a shearing frame mounted on said machine frame so as to be displaceable in the longitudinal direction of said run-out roller table, an upper and a lower cutter arranged in said shearing frame, and drive and control aggregates provided for moving said upper and said lower cutters towards and away from each other, the improvement which is characterized in that:

said machine frame exceeds said run-out roller table in terms of height, said shearing frame rests loosely on said machine frame, said drive and control aggregates are mounted to said shearing frame and form a construction unit with said shearing frame, and a displacement mechanism is fastened to said machine frame and engages said shearing frame, a hook coupling being provided for connecting said displacement mechanism to said shearing frame, said hook coupling permitting vertical movement of said shearing frame.

* * * * *